US009449611B2

(12) United States Patent
Leveau et al.

(10) Patent No.: US 9,449,611 B2
(45) Date of Patent: Sep. 20, 2016

(54) SYSTEM AND METHOD FOR EXTRACTION OF SINGLE-CHANNEL TIME DOMAIN COMPONENT FROM MIXTURE OF COHERENT INFORMATION

(71) Applicant: Audionamix, Paris (FR)

(72) Inventors: Pierre Leveau, Paris (FR); Xabier Jaureguiberry, Paris (FR)

(73) Assignee: AUDIONAMIX, Paris (FR)

( * ) Notice: Subject to any disclaimer, the term of this patent is extended or adjusted under 35 U.S.C. 154(b) by 923 days.

(21) Appl. No.: 13/632,863

(22) Filed: Oct. 1, 2012

(65) Prior Publication Data

US 2013/0084057 A1 Apr. 4, 2013

(30) Foreign Application Priority Data

Sep. 30, 2011 (FR) ..... 11 58831

(51) Int. Cl.
*G10L 21/0272* (2013.01)

(52) U.S. Cl.
CPC ..... *G10L 21/0272* (2013.01)

(58) Field of Classification Search
CPC ..... G10L 21/0208
See application file for complete search history.

(56) References Cited

U.S. PATENT DOCUMENTS

| | | | | |
|---|---|---|---|---|
| 5,204,969 | A * | 4/1993 | Capps et al. | 704/278 |
| 5,792,971 | A * | 8/1998 | Timis et al. | 84/609 |
| 5,848,163 | A * | 12/1998 | Gopalakrishnan et al. | 381/56 |
| 6,317,703 | B1 * | 11/2001 | Linsker | 702/190 |
| 6,343,268 | B1 * | 1/2002 | Balan et al. | 704/228 |
| 6,446,041 | B1 * | 9/2002 | Reynar et al. | 704/260 |
| 6,879,952 | B2 * | 4/2005 | Acero et al. | 704/222 |
| 6,983,264 | B2 * | 1/2006 | Shimizu | 706/22 |
| 7,076,433 | B2 * | 7/2006 | Ito et al. | 704/500 |
| 7,243,060 | B2 * | 7/2007 | Atlas et al. | 704/200 |
| 8,571,853 | B2 * | 10/2013 | Peleg et al. | 704/208 |
| 2004/0064307 | A1 * | 4/2004 | Scalart | G10L 21/0208 704/205 |
| 2007/0021959 | A1 * | 1/2007 | Goto | 704/233 |
| 2009/0163168 | A1 * | 6/2009 | Andersen | G10L 21/0208 455/307 |
| 2012/0004911 | A1 * | 1/2012 | Quan | 704/235 |
| 2012/0005701 | A1 * | 1/2012 | Quan | 725/9 |
| 2013/0339011 | A1 * | 12/2013 | Visser et al. | 704/207 |
| 2014/0163980 | A1 * | 6/2014 | Tesch et al. | 704/235 |

FOREIGN PATENT DOCUMENTS

EP 1744305 A2 1/2007

OTHER PUBLICATIONS

Févotte, Cédric, Nancy Bertin, and Jean-Louis Durrieu. "Nonnegative matrix factorization with the Itakura-Saito divergence: With application to music analysis." Neural computation 21.3 (2009): 793-830.*

(Continued)

*Primary Examiner* — Matthew Baker
(74) *Attorney, Agent, or Firm* — Leydig, Voit & Mayer, Ltd.

(57) ABSTRACT

A computer readable medium containing computer executable instructions is described for extracting a reference representation from a mixture representation that comprises the reference representation and a residual representation wherein the reference representation, the mixture representation, and the residual representation are representations of collections of acoustical waves stored on computer readable media.

17 Claims, 3 Drawing Sheets

(56) References Cited

OTHER PUBLICATIONS

Durrieu, Jean-Louis, Barak David, and Guilhem Richard. "A musically motivated mid-level representation for pitch estimation and musical audio source separation." Selected Topics in Signal Processing, IEEE Journal of 5.6 (Sep. 16, 2011): 1180-1191.*

Févotte, Cédric. "Majorization-minimization algorithm for smooth Itakura-Saito nonnegative matrix factorization." Acoustics, Speech and Signal Processing (ICASSP), 2011 IEEE International Conference on. IEEE, 2011.*

Plumbley, Mark D., et al. "Automatic music transcription and audio source separation." Cybernetics &Systems 33.6 (2002): 603-627.*

Mitianoudis, Nikolaos, and Michael E. Davies. "Audio source separation of convolutive mixtures." Speech and Audio Processing, IEEE Transactions on 11.5 (2003): 489-497.*

Jaureguiberry, Xabier, et al., "Adaptation of Source-Specific Dictionaries in Non-Negative Matrix Factorization for Source Separation," *IEEE International Conference on Acoustics, Speech and Signal Proccessing*, (ICASSP, 2011) May 22, 2011, pp. 5-8, XP032000649.

Durrieu, Jean Louis, et al., "An Interative Approach to Monaural Musical Mixture De-Soloing", *IEEE International Conference on Acoustics, Speech and Signal Proccessing*, (ICASSP 2009), IEEE, Piscataway, NJ, USA, Apr. 19, 2009, pp. 105-108, XP031459177.

Smaragdis, Paris, "Convolutive Speech Bases and Their Application to Supervised Speech Separation," *IEEE Transactions on Audio, Speech and Language Processing, IEEE* Service Center, New York, NY, USA, vol. 15., No. 1, Jan. 1, 2007, pp. 1-12. XP011151936.

Hardwick John., et al., "Speech Enhancement Using the Dual Excitation Speech Model," *IEEE International Conference on Acoustics, Speech, and Signal Pnocessing* (ICASSP-93), IEEE Piscataway, NJ, USA, vol. 2, Apr. 27, 1993, pp. 367-370, XP010110470.

International Search Reporting for co-pending international application No. PCT/IB2012/002556 filed on Oct. 1, 2012.

Jaureguiberry, Xabier, et al., "Adaptation of Source-Specific Dictionaries In Non-Negative Matrix Factorization for Source Separation" *IEEE*, ICASSP, 2011, pp. 5-8.

Durrieu, Jean-Louis, et al., "An Iterative Approach to Monaural Musical Mixture De-Solong", *IEEE*, ICASSP, 2009, pp. 105-108.

Hardwick, John, et al., "Speech Enhancement Using the Dual Excitation Speech Model" *IEEE*, 1993, pp. II-367-II-370.

Smaragdis, Paris, Abstract entitled, "Convolutive Speech Bases and Their Application to Supervised Speech Separation", Mitsubishi Electric Research Laboratories, TR2007-002, Jan. 2007,1 page.

Smaragdis, Paris, "Concolutive Speech Bases and Their Application to Supervised Speech Separation", *IEEE Transaction on Audio, Speech and Language Processing*, (Jan. 2007), p. 1-14.

* cited by examiner

SYSTEM AND METHOD FOR EXTRACTION OF SINGLE-CHANNEL TIME DOMAIN COMPONENT FROM MIXTURE OF COHERENT INFORMATION

TECHNICAL FIELD

The invention is in the field of the processes and systems of removal of a specific acoustical contribution from the signal of an acoustical signal mixture.

BACKGROUND

A movie soundtrack or a series soundtrack can contain a music track mixed with, the actors voices or dubbed speech and other audio effects. However, movie or series studios may have obtained the music distribution rights only for a given territory, a given medium (DVD, Blu-Ray, VOD) or for a given duration. It is thus impossible to distribute the audiovisual content including a soundtrack that includes music for which the studio or other distributor of audiovisual content does not have rights to within a territory, beyond a previously expired duration, or for a particular medium, unless high fares are paid to the owners of the music rights.

Thus, there is a need for a process enabling the extraction of a specific acoustical component, such as a musical component, from the acoustical signal mixture, such as the original soundtrack, in order to keep only a residual contribution, such as the voice of the actors and/or the sound effects and other acoustical components for which the distributor of the audiovisual content has the rights to.

Such a process will afford the possibility of reworking the residual contribution to, for example, incorporate other music.

In order to perform such an extraction, one approach consists of considering as known the musical recording corresponding to the contribution to be removed from the mixture. More specifically, we consider a reference acoustical signal that corresponds to a specific recording of the music contribution in the mixture.

Thus, the document Goto, US Pat. Pub. No. 20070021959 (hereinafter "Goto") discloses a process of music removal capable of subtracting from the acoustical signal mixture, the reference signal, through application of transformations, to obtain a residual signal corresponding to the residual contribution in the initial mixture.

To take into account the differences in volume, temporal position, equalization, etc. between the reference signal and the musical contribution in the mixture, Goto discloses the possibility of correcting the reference signal automatically before subtracting it from the mixture. Goto proposes to perform the correction in a manual way, with the help of a graphical user interface. While the residual acoustical component is not satisfactory, the operator performs an iteration consisting of correcting the reference signal and then subtracting it from the mixture. Given the large number of parameters on which it is possible to modify the reference signal, this known process is not efficient.

The publication by Jaureguiberry et al. "Adaptation of a source-specific dictionaries in Non-Negative Matrix Factorization for source separation", Int. Conf. on Acoustics, Speech and Signal Processing 2011, discloses a process of acoustical contribution removal, where the modeling of the contribution to remove involves the learning of time-independent spectral shapes (or power spectral densities) on a reference signal, and an adaptation of these spectral shapes with a vector of frequential factors to model the discrepancies between the reference source and the contribution. Results of this method are not satisfactory because of the loss of the temporal structure of the reference acoustical component, and also because the adaptation may not compensate for the differences in the recordings of the reference and of the contribution, that may have very different characteristics (e.g. not the same sound sources, not the same acoustical conditions, not the same note played, etc.).

SUMMARY

The present invention aims to address these issues by proposing an improved extraction process, taking into account, in an automatic manner, the differences between the reference acoustical component and the specific acoustical component to be extracted from the acoustical mixture that constitutes different recordings of a known collection of acoustical waves.

According to one embodiment of the invention, a computer readable medium containing executable instructions is described for extracting a reference representation from a mixture representation that comprises the reference representation and a residual representation wherein the reference representation, the mixture representation, and the residual representation are representations of collections of acoustical waves stored on computer readable media, the process comprising a executable instructions for correcting a short-time power spectral density of a time-frequency version of the reference representation, wherein the short-time power spectral density is a function of time and frequency, stored on a computer readable medium, computed by taking the power spectrogram of the reference representation to obtain a corrected short-time power spectral density of the reference representation, executable instructions for estimating a short-time power spectral density of a time-frequency version of the residual representation, which is a function of time and frequency stored on a computer readable medium, from the time-frequency version of the mixture representation and the corrected short-time power spectral density of the reference representation, executable instructions for filtering the time-frequency version of the mixture representation, from the estimated short-time power spectral density of the residual representation and the corrected short-time power spectral density of the reference representation, and executable instructions for storing the residual representation on a computer readable medium.

According to another embodiment of the invention, a system is described for extracting a reference representation from a mixture representation that comprises the reference representation and a residual representation wherein the reference representation, the mixture representation, and the residual representation are representations of collections of acoustical waves stored on computer readable media, the system comprising a processor configured to perform a correction of the short-time power spectral density of the time-frequency version of the reference representation, an estimation of the short-time power spectral density of the residual representation, and a filtering that is designed to obtain, from the time-frequency version of the reference representation, from the estimated short-time power spectral density of the time-frequency version of the residual representation, and from the corrected short-time power spectral density of the time-frequency version of the reference representation, the time-frequency version of the residual representation, and a memory configured to store the reference representation, the mixture representation, the residual representation, the time-frequency version of the reference representation, the time-frequency version of the mixture representation, the time-frequency version of the residual representation, the short-time power spectral density of the time-frequency version of the reference representation, the short-time power spectral density of residual representation, the estimated short-time power spectral density of the time-frequency version of the residual representation, and the corrected short-time power spectral density of the time-frequency version of the reference representation.

BRIEF DESCRIPTION OF THE DRAWINGS

The invention will be better understood with the help of the following description, given only as an example and that refers to the enclosed drawings on which.

DETAILED DESCRIPTION

Figure 1:
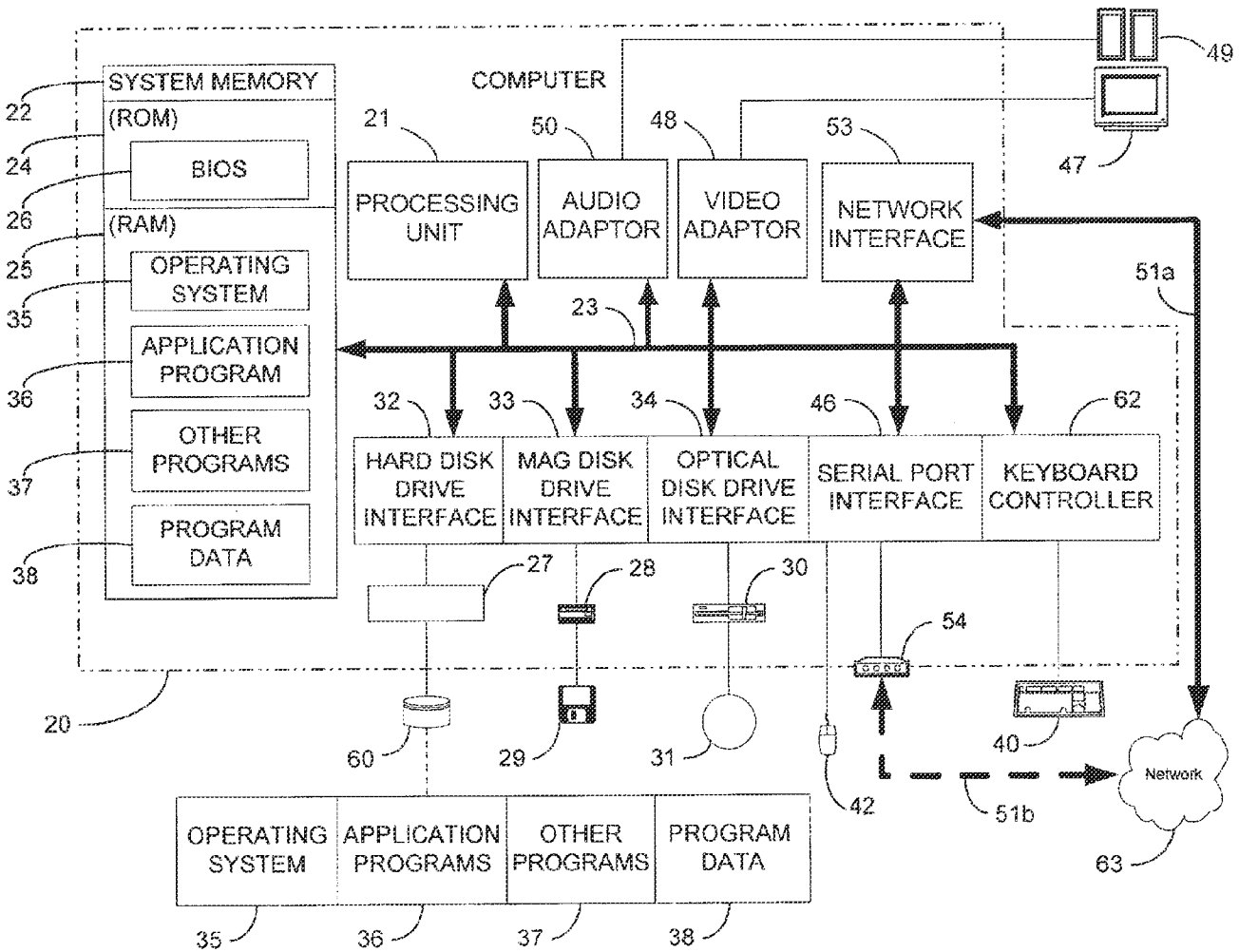
FIG. 1 is a block diagram illustrating an example of the computer environment in which the present invention may be used.

Turning now to the figures, wherein like reference numerals refer to like elements, an exemplary environment in which the present invention may be implemented is shown in FIG. 1. The environment includes a computer 20, which includes a central processing unit (CPU) 21, a system memory 22, and a system bus 23. The system memory 22 includes both read only memory (ROM) 24 and random access memory (RAM) 25. The ROM 24 stores a basic input/output system (BIOS) 26, which contains the basic routines that assist in the exchange of information between elements within the computer, for example, during start-up. The RAM 25 stores a variety of information including an operating system 35, an application program 36, other programs 37, and program data 38. The computer 20 further incorporates a hard disk drive 27, which reads from and writes to a hard disk 60, a magnetic disk drive 28, which reads from and writes to a removable magnetic disk 29, and an optical disk drive 30, which reads from and writes to a removable optical disk 31, for example a CD, DVD, or Blu-Ray disc.

The system bus 23 couples various system components, including the system memory 22, to the CPU 21. The system bus 23 may be of any of several types of bus structures including a memory bus or memory controller, a peripheral bus, and a local bus using any of a variety of bus architectures. The system bus 23 connects to the hard disk drive 27, magnetic disk drive 28, and optical disk drive 30 via a hard disk drive interface 32, a magnetic disk drive interface 33, and an optical disk drive interface 34, respectively. The drives and their associated computer-readable media provide nonvolatile storage of computer readable instructions, data structures, programs, and other data for the computer 20. While the exemplary environment described herein contains a hard disk 60, a removable magnetic disk 29, and a removable optical disk 31, the present invention may be practiced in alternative environments which include one or more other varieties of computer readable media. That is, it will be appreciated by those of ordinary skill in the art that other types of computer readable media capable of storing data that in a manner such that it is accessible by a computer may also be used in the exemplary operating environment.

A user may enter commands and information into the computer 20 through input devices such as a keyboard 40, which is ordinarily connected to the computer 20 via a keyboard controller 62, and a pointing device, such as a mouse 42. The present invention may also be practiced in alternative environments which include a variety of other input devices not shown in FIG. 1. For example, the present invention may be practiced in an environment where a user communicates with the computer 20 through other input devices including but not limited to a microphone, joystick, touch pad, wireless antenna, and a scanner. Such input devices are frequently connected to the CPU 21 through a serial port interface 46 that is coupled to the system bus. However, input devices may also be connected by other interfaces such as a parallel port, game port, a universal serial bus (USB), or a 1394 bus.

The computer 20 may output various signals through a variety of different components. For example, in FIG. 1 a monitor 47 is connected to the system bus 23 via an interface such as video adapter 48. Alternatively, other types of display devices may also be connected to the system bus. The environment in which the present invention may be carried out is also likely to include a variety of other peripheral output devices not shown in FIG. 1 including but not limited to speakers 49, which are connected to the system bus 23 via an audio adaptor, and a printer.

The computer 20 may operate in a networked environment by utilizing connections to one or more devices within a network 63, including another computer, a server, a network pC, a peer device or other network node. These devices typically include many or all of the components found in the exemplary computer 20. In FIG. 1, the logical connections utilized by the computer 20 include a land-based network link 51. possible implementations of a land-based network link 51 include a local area network link (LAN) link and a wide area network (WAN) link, such as the Internet. When used in an environment comprising a LAN, the computer 20 is connected to the network through a network interface card or adapter 53. When used in an environment comprising a WAN, the computer 20 ordinarily includes a modem 54 or some other means for establishing communications over the network link 51, as shown by the dashed line in FIG. 1. The modem 54 is connected to the system bus 23 via serial port interface 46 and may be either internal or external. Land-based network links include such physical implementations as coaxial cable, twisted copper pairs, fiber optics, and the like. Data may be transmitted across the network link 51 through a variety of transport standards including but not limited to Ethernet, SONET, DSL, T-1, T-3, and the like. In a networked environment in which the present invention may be practiced, programs depicted relative to the computer 20 or portions thereof may be stored on other devices within the network 63.

Those of ordinary skill in the art will understand that the meaning of the term "computer" as used in the exemplary environment in which the present invention may be implemented is not limited to a personal computer but may also include other microprocessor or microcontroller-based systems. For example, the present invention may be implemented in an environment comprising hand-held devices, smart phones, tablets, multi-processor systems, microprocessor based or programmable consumer electronics, network pCs, minicomputers, mainframe computers, Internet appliances, and the like. The invention may also be practiced in distributed computing environments where tasks are performed by remote processing devices that are linked through a communications network. In a distributed computing environment, parts of a program may be located in both local and remote memory storage devices.

In the description that follows, the invention will be described with reference to acts and symbolic representations of operations that are performed by one or more logic elements. As such, it will be understood that such acts and operations may include the execution of microcoded instructions as well as the use of sequential logic circuits to transform data or to maintain it at locations in the memory system of the computer or in the memory systems of a distributed computing environment. Reference will also be made to one or more programs executing on a computer system or being executed by parts of a CPU. A "program" is any instruction or set of instructions that can execute on a computer, including a process, procedure, function, executable code, dynamic-linked library (DLL), applet, native instruction, engine, thread, or the like. A program may also include a commercial software application or product, which may itself include several programs. However, while the invention is being described in the context of software, it is not meant to be limiting. Those of skill in the art will appreciate that various acts and operations described hereinafter may also be implemented in hardware.

The invention is generally directed to a system and method for processing a mixture of coherent information and extracting a particular component from the mixture. According to one embodiment of the invention, a representation of a collection of acoustical waves stored on a computer readable medium and a second representation of a second collection of acoustical waves stored on a computer readable medium are provided as inputs into a system. In said embodiment, the system comprises a processor, configured to extract, from the representation of the first collection of acoustical waves, the representation of a second collection of acoustical waves to yield a representation of a third collection of acoustical waves. The system may include various components, e.g. the CPU 21, described in the exemplary environment in which the invention may be practiced as illustrated in FIG. 1. Components of the system may be stored on computer readable media, for example the system memory 22. The system may include programs, for example an application program 36. The system may also comprise a distributed computing environment where information and programs are stored on remote devices which are linked through a communication network.

Figure 2:
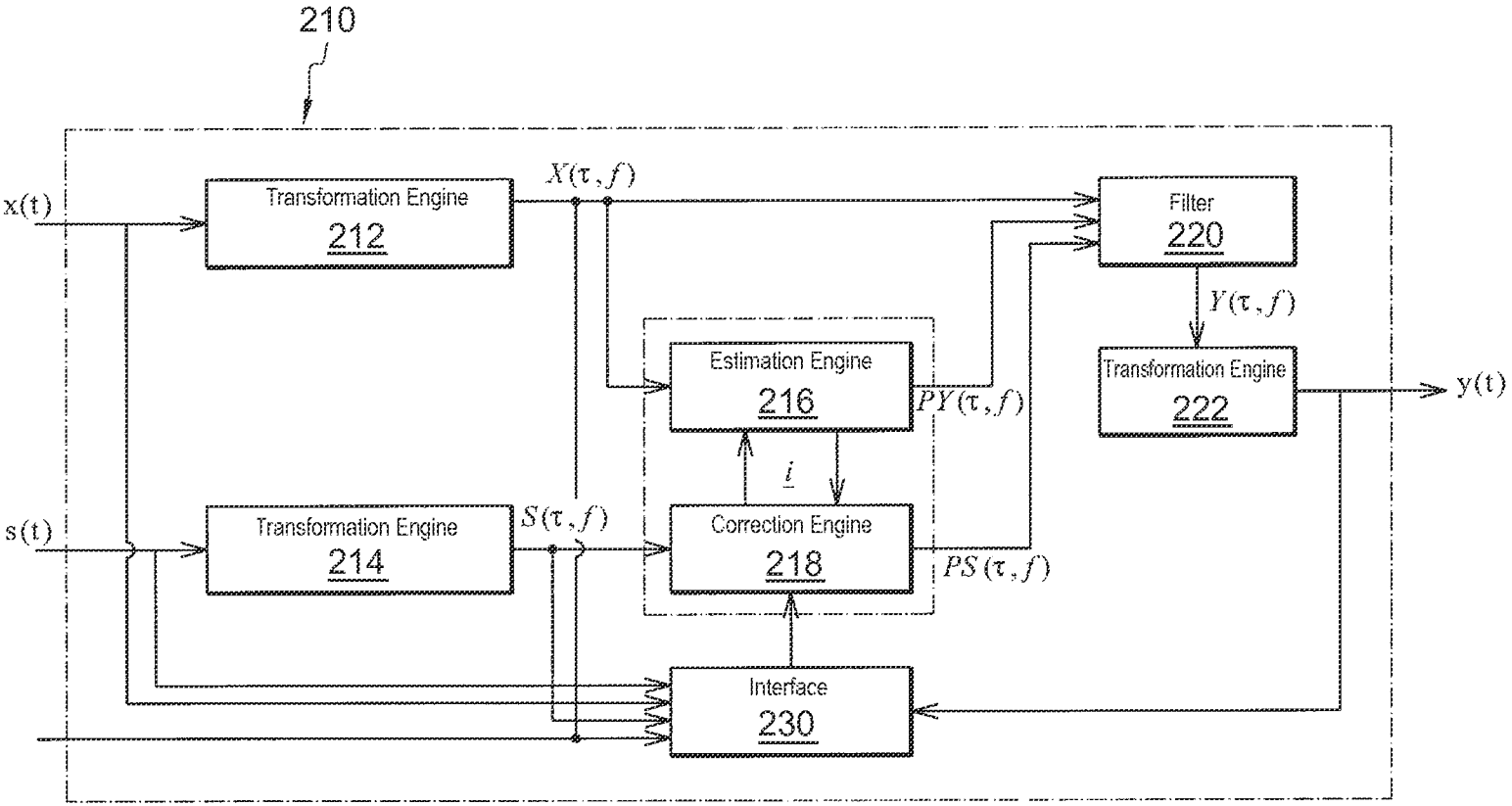
FIG. 2 is a schematic view of the system according to one embodiment of the invention.

Referring to FIG. 2, the system for extraction 210 takes as inputs a first representation of a first collection of acoustical waves stored on a computer readable medium, i.e. a mixture representation x(t), and a second representation of a second collection of acoustical waves stored on a computer readable medium, i.e. a reference representation s(t), to deliver, as output, a representation of a third collection of acoustical waves stored on a computer readable medium, i.e. a residual representation y(t). In this embodiment, the representations are temporal representations, i.e. they are functions of time. All collections of waves in the present embodiment are collections of acoustical waves, so the term acoustical may be omitted throughout the remainder of the description. The representations may be stored, e.g., as program data 38 in FIG. 1 or otherwise in the system memory 22 of FIG. 1

In the implementations herein described in detail, the representations of collections of waves are obtained from monophonic recordings. Alternatively, they may be obtained from stereophonic recordings. More generally, they may be obtained from multichannel recordings. One of skill in the art knows how to adapt the process detailed below to deal with representations of collections of waves obtained from monophonic, stereophonic or multichannel recordings.

The mixture representation comprises a representation of a first component and a representation of a second component, each component itself being a collection of waves. The first component is musical and corresponds to known music. The second component is residual and corresponds to voices, to sound effects, or to other acoustics. Thus the mixture representation comprises a musical representation, i.e. the representation of the musical component, and a residual representation, i.e. a representation of the residual component.

The reference representation corresponds to the known music. The verb "to correspond" indicates that the reference representation and the musical representation are obtained from two different treatments of recordings of the same musical performance. Each treatment can leave a recording unchanged (identity function), modify the signal power (or volume) of a recording, or modify the level of frequency equalization of a recording. Each treatment can be analogic (acoustic propagation, analogic electronic processing) or digital (digital electronic processing, software processing), or a combination thereof.

Thus, in the first implementation of the invention, a power difference between the musical representation and the reference representation is taken into account at each sampling time of a time-frequency version of the musical representation. A time-frequency version of any acoustical representation stored on a computer readable medium may be obtained by performing a transformation on the acoustical representation. Any resultant time-frequency version of the representation may then also be stored on a computer readable medium.

The system 210 comprises a processor, such as CPU 21 in FIG. 1, consuming executable code, to provide a first transformation engine 212 configured to perform a first transformation and a second transformation engine 214 configured to perform a second transformation. The transformations are performed in the time-frequency domains to transform a representation of a collection of sound waves stored on a computer readable medium, e.g. the mixture representation, the reference representation, etc., into a time-frequency version of the representation of a collection of acoustical waves stored on a computer readable medium. preferably, in this embodiment, the transformations involve implementation of the same local Fourier Transform, and in particular, the Short-Time Fourier Transform. The time-frequency version obtained as an output depends on a temporal variable $\tau$, which is a characteristic of the windowing operator of the transformation, and on a frequential variable f. Generally speaking, the transformation to the time-frequency domain may involve any type of invertible transform. The short-time power spectral density is the sequence of power spectral densities (indexed by f) of the representation on each of the windows (indexed by $\tau$) defined in the windowing operator of the transformation, and is thus dependent on the temporal variable $\tau$ and the frequential variable f.

The first transformation engine 212 computes a first transformation, from the mixture representation, the time-frequency version of the mixture representation $X(\tau,f)$, which may then be stored on computer readable media, e.g. as program data 38 in FIG. 1.

The second transformation engine 214 computes a second transformation, from the reference representation, the time-frequency version of the reference representation S(τ,f), which may then be stored on computer readable media, e.g. as program data 38 in FIG. 1.

The processor of system 210 is further configured to perform an estimation function at an estimation engine 216 of the short-time power spectral density of the time-frequency version of the mixture representation to estimate the power spectrogram of the time-frequency version of the residual representation PY(τ,f), which may then be stored on computer readable media, e.g. as program data 38 in FIG. 1.

The processor of system 210 is further configured to perform a correction function at correction engine 218 of the short-time power spectral density to determine a corrected short-time power spectral density of the time-frequency version of the reference representation PS(τ,f), which may then be stored on computer readable media, e.g. as program data 38 in FIG. 1.

According to the invention, the estimation function performed by estimation engine 216 and the correction function performed by correction engine 218 are coupled together through an iteration loop, i.e. an estimation-correction loop, indexed by an integer i.

At each iteration, the estimation function performed by estimation engine 216 produces an approximation of the short-time power spectral density of the time-frequency version of the residual representation PY, which may be stored on a computer readable medium. In the envisaged implementations this approximation takes the following shape:

$$PY_i = W_i H_i \tag{1}$$

Where $W_i$ is a matrix $(w_i^{j,k})$ of J lines per K columns and $H_i$ a matrix $(h_i^{k,l})$ of K lines and L columns, where J is the number of frequency frames and L the number of temporal frames. Both matrices may be stored on a computer readable medium, e.g. in system memory 22 as program data 38 in FIG. 1.

Equation (1) models the short-time power spectral density of the residual representation in a first matrix $W_i$ corresponding to elementary spectral shapes (chords, phonemes, etc.) and a second matrix $H_i$ corresponding to the activation in time of these elementary spectral shapes.

The estimation engine 216 is configured to consecutively execute first and second instructions, which may be stored, e.g., as part of a program 37 in computer readable media such as system memory 22, in FIG. 1, at each iteration to update matrices $W_i$ and $H_i$.

The first instruction, which updates $W_i$, takes the time-frequency version of the mixture representation X(τ,f), and the matrix $H_i$, the matrix $W_i$ and the corrected short-time power spectral density of the time-frequency version of the reference representation $PS_i(\tau,f)$ given by the correction function performed by correction engine 218, computed at the previous iteration.

preferably, this first instruction uses the following formula:

$$W_{i+1} = W_i \cdot \frac{((W_i H_i + PS_i))^{\wedge(.-2)} \cdot |X|^2) \cdot H_i^T}{(W_i H_i + PS_i)^{\wedge(.-1)} \cdot H_i^T} \tag{2}$$

where, generally speaking, $M^T$ is the matrix transpose operation of matrix M and $M^{\wedge(.-1)}$ is the matrix inversion operation of matrix M in the sense of the Hadamard product (element by element inversion, not the inverse of the classical matrix product), and where $|X|^2$ is the square of the modulus of the complex amplitude of the time-frequency version of the mixture representation X(τ,f). The various matrices and products may be stored on computer readable media, e.g. as program data 38 in FIG. 1.

The second instruction for updating matrix $H_i$ takes as input the time-frequency version of the mixture representation X(τ,f), and the matrix $H_i$, the matrix $W_i$ and the corrected short-time power spectral density of the time-frequency version of the reference representation $PS_i(\tau,f)$ given by the correction function performed by the correction engine 218, computed at the previous iteration. preferably, this second instruction uses the following formula:

$$H_{i+1} = H_i, \frac{W_i^T \cdot ((W_i H_i + PS_i)^{\wedge(.-2)} \cdot |X|^2)}{W_i^T \cdot (W_i H_i + PS_i)^{\wedge(.-1)}} \tag{3}$$

The correction engine 218 is configured to, at each iteration, perform a correction of the short-time power spectral density of the time-frequency version of the reference representation S(τ,f) to produce a corrected reference short-time power spectral density of the time-frequency version of the reference representation $PS_i$. This last variable depends on the complex amplitude of the time-frequency version of the reference representation through a correction function:

$$PS_i \Im_i(|S|^2) \tag{4}$$

In an implementation, the correction function has the shape:

$$\Im_i(|S|^2) = \alpha_i \cdot |S|^2 \tag{4.1}$$

Where $\alpha_i$ is a gain whose value is updated at each iteration of the loop by executing a gain correction instruction at the correction function performed by correction engine 218. The correction function performed by correction engine 218 involves using the time-frequency version of the mixture representation X(τ,f), the time-frequency version of the reference representation S(τ,f), the matrix $H_i$, the matrix $W_i$, and the gain $\alpha_i$ computed at the previous iteration in conjunction with the following formula:

$$\alpha_{i+1} = \alpha_i \cdot \frac{\sum_{j,l} (|S|^2 \cdot (W_i H_i + \alpha_i \cdot |S|^2)^{\wedge(.-2)} \cdot |X|^2)}{\sum_{j,l} (|S|^2 \cdot (W_i H_i + \alpha_i |S|^2)^{\wedge(.-1)})} \tag{5}$$

Where $|S|^2$ is the squared modulus of the time-frequency version of the reference representation S(τ,f).

After a hundred iterations of the loop, the estimated short-time power spectral density of the time-frequency version of the residual representation PY(τ,f) is obtained by means of Equation (1) with the then current values of matrices $H_i$ et $W_i$.

The processor of system 210 is further configured by executable code to perform a filtering function at a filter 220 that implements a Wiener filtering algorithm to estimate the time-frequency version of the residual representation Y(τ,f), from the estimated short-time power spectral density of the time-frequency version of the residual representation PY(τ,f), the corrected short-time power spectral density of the time-frequency version of the reference representation PS(τ,f) and the time-frequency version of the mixture representation X(τ,f).

For example, the Wiener filtering implemented by filter 220 follows the equation:

$$Y(\tau, f) = \frac{PY(\tau, f)}{PS(\tau, f) + PY(\tau, f)} \cdot X(\tau, f) \quad (6)$$

One of ordinary skill in the art will eventually modify the Wiener filtering to influence the quality of the rendering. For example, the short-time power spectral densities coefficients PY(τ,f) and PS(τ,f) may be raised to a given real power in order to improve the rendering quality.

The processor of system 210 is further configured to perform a third transformation at transformation engine 222 designed to transform a time-frequency version of a representation of a collection of waves stored on a computer readable medium, taken as input, into a temporal representation, i.e. a function of time, of a collection of waves stored on a computer readable medium. The transformation performed by transformation engine 222 involves implementing the transform function that is the inverse of the one implemented in the transformations performed by transformation engines 212 and 214. preferably, a Fourier inverse transform is performed on each of the temporal frames of the time-frequency versions of the representations, and then an overlap-and-add operation is performed on the resulting temporal versions of each frame. When it is applied on the time-frequency version of the residual representation Y(τ,f), the transformation performed by transformation engine 222 provides the residual representation, which may be stored on a computer readable medium, y(t).

Finally, the extraction system comprises an interface 230, preferably graphical, allowing the operator to enter the values of the parameters such as the number of iterations of the estimation-correction loop, the initial value of a gain, and various other parameters which may be obvious for those of skill in the art to provide user control over. For example and preferably, the gains $\alpha_0$, $\beta_0$ and $\gamma_0$ may be initialized with a unit value.

The interface 230 also enables selection of a method from among a set of methods for setting values of said parameters. Such methods are particularly applicable to the initialization of the matrices $W_0$ and $H_0$ which may be stored on a computer readable medium. For example, the choice of a stochastic method can trigger the execution of a modulus of matrix initialization $W_0$ and $H_0$ designed to set, in a stochastic way, a value between 0 and 1 to each of the elements of one or the other matrices. Other methods can be envisaged by one of skill in the art.

Figure 3:
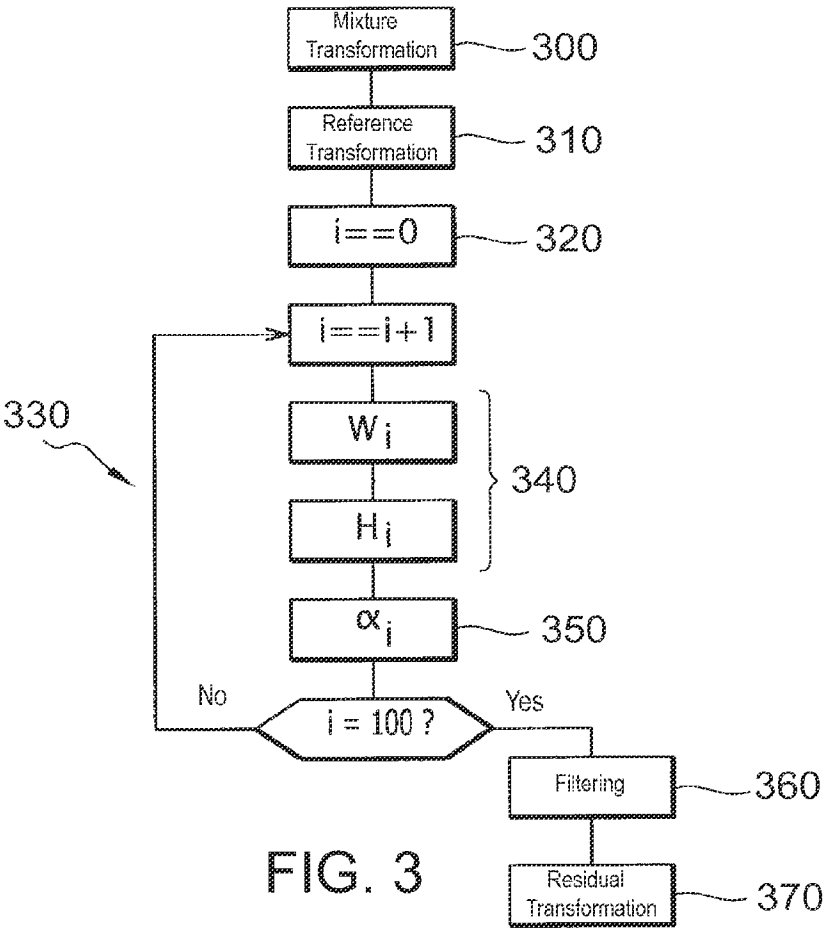
FIG. 3 is a block-diagram representation of the several steps involved in the process according to an implementation of the invention.

FIG. 3 depicts an implementation of the extraction method described by the present invention. At step 300, the mixture representation is transformed into the time-frequency version of the mixture representation by performing a transformation such as that performed by transformation engine 212 of FIG. 2.

At step 310, the reference representation is transformed into the time-frequency version of the reference representation by performing a transformation such as that performed by transformation engine 214 of FIG. 2.

At step 320, an initialization of several parameters, e.g. integer i, number of spectral shapes K, gains, number of iterations in the estimation correction loop, etc. and an initialization of matrices $W_0$ and $H_0$ occurs. At step 330, the method comprises initializing the estimation correction loop 330, indexed by the integer i.

At each iteration, the method comprises performing an estimation function (140) consisting of updating the matrix $W_i$ and subsequently the matrix $H_i$, and further comprises a correction function 350 that updates the value of the gain parameter $\alpha_i$. The estimation function 340 and correction function 350 are identical to the estimation function and correction function performed by the estimation engine 216 and correction engine 218 of FIG. 2, respectively.

After around 100 iterations of the estimation correction loop 330, the short-time power spectral density of the time-frequency version of the residual representation is determined according to equation (1) with the last values of matrices $W_i$ then $H_i$, and the corrected short-time power spectral density of the time-frequency version of the reference representation is determined according to equation (4.1) with the last value of gain $\alpha_i$.

At step 360, a filtering function, such as that performed by filter 220 in FIG. 2, is performed to yield the time-frequency version of the residual representation from the short-time power spectral density of the time-frequency version of the residual representation, the corrected short-time power spectral density of the time-frequency version of the reference representation, and the time-frequency version of the mixture representation.

Finally, at step 370 a transformation function, such as performed by the transformation engine 222 in FIG. 2, is performed to yield the residual representation y(t), from the time-frequency version of the residual representation.

In a second implementation of the extraction method, which is identical to the first implementation described above except that in this second implementation, the correction function is a function that modifies a vector of gain factors and a vector of frequency factors, that can be written as follows:

$$\Im_i(|S|^2) = \mathrm{diag}(\beta_i) \cdot |S|^2 \cdot \mathrm{diag}(\gamma_i) \quad (4.2)$$

Therein, $\beta_i$ is a vector of factors of frequency adaptation, and $\gamma_i$ is a vector of factor of gain specific to a time frame, and the function $\mathrm{diag}(v_i)$ enables construction of a matrix from a vector $v_i$ by distributing the coordinates of the vector on the matrix diagonal.

The correction function in this alternative embodiment comprises first updating the vector of gain factors using the time-frequency version of the mixture representation X(τ,f), the time-frequency version of the reference representation S(τ,f), the matrix $H_i$, the matrix $W_i$, and the values of vectors $\gamma_i$ and $\beta_i$ at the previous iteration according to the following relationship:

$$\gamma_{i+1} = \gamma_i \cdot \frac{\sum_j \left(\mathrm{diag}(\beta_i)|S|^2 \cdot (W_i H_i + \mathrm{diag}(\beta_i)|S|^2 \mathrm{diag}(\gamma_i))^{\wedge(-2)} \cdot |X|^2\right)}{\sum_j \left(\mathrm{diag}(\beta_i)|S|^2 \cdot (W_i H_i + \mathrm{diag}(\beta_i)|S|^2 \mathrm{diag}(\gamma_i))^{\wedge(-1)}\right)} \quad (7)$$

The correction function subsequently comprises updating the frequency adaptation factors using the time-frequency version of the mixture representation X(τ,f), the time-frequency version of the reference representation S(τ,f), the matrix $H_i$, the matrix $W_i$, and the values of vectors $\gamma_i$ and $\beta_i$ at the previous iteration according to the following relationship:

$$\beta_{i+1} = \beta_i \cdot \frac{\sum_i \left(|S|^2 \mathrm{diag}(\gamma_i) \cdot (W_i H_i + \mathrm{diag}(\beta_i)|S|^2 \mathrm{diag}(\gamma_i))^{\wedge(-2)} \cdot |X|^2\right)}{\sum_i \left(|S|^2 \mathrm{diag}(\gamma_i) \cdot (W_i H_i + \mathrm{diag}(\beta_i)|S|^2 \mathrm{diag}(\gamma_i))^{\wedge(-1)}\right)} \quad (8)$$

Figure 4:
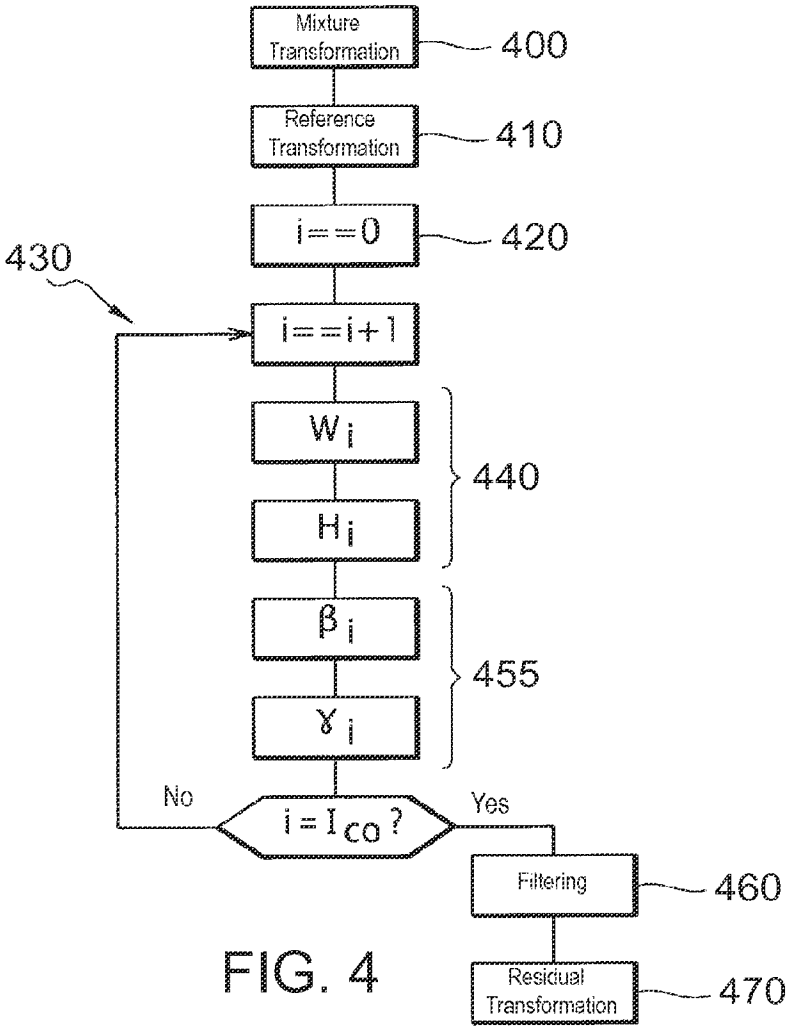
FIG. 4 is a block-diagram representation of the several steps involved in the process according to an alternative implementation.

FIG. 4 is a schematic diagram of this alternative embodiment of the present invention. Steps 400, 410, 420, 460, and 470 in FIG. 4 are identical to corresponding steps 300, 310, 320, 360, and 370 of the implementation described in FIG. 3, In FIG. 4, the estimation-correction loop 430 now comprises the step 440 of updating matrix $W_i$ then subsequently updating matrix $H_i$, followed by the step 455 of updating respectively the vector of gain factors $\gamma_i$ and the vector of frequency adaptation factors $\beta_i$. The various vectors and matrices may be stored on a computer readable medium, e.g. as program data 38 in FIG. 1.

After a hundred iterations of the loop 430, the value of the short-time power spectral density of the time-frequency version of the residual representation is computed according to equation (1) with the then current values of matrices $W_i$ and $H_i$, while the short-time power spectral density of the corrected time-frequency version of the reference representation is computed according to equation (4.2) with the then current values of vectors $\gamma_i$ and $\beta_i$.

The general principle implemented in the estimation-correction loop involved in the invention consists of minimizing a divergence between, on the one hand, the short-time power spectral density and, on the other hand, the sum of the short-time power spectral density of the corrected time-frequency version of the reference representation and of the short-time power spectral density of the time-frequency version of the residual representation. preferably, this divergence is the known ITAKURA-SAITO divergence. See Fevotte C., Berlin N., Durrieu J.-L., Nonnegative matrix factorization with the Itakura-Saito divergence with application to music analysis, Neural Computation, March 2009, Vol 21, number 3, pp 793-830. This divergence enables quantifying a perceptual difference between two acoustical spectra. In particular, this distance is not sensitive to scale differences between compared spectra. The ITAKURA-SAITO divergences between two points having a scale difference with two others are identical The problem of minimizing the aforementioned divergence stated in the previous paragraph requires a minimization algorithm to solve it. The minimization methods described in this invention comes from a derivation operation of this divergence with respect to the variables that are, in the first implementation, the matrices W, H and the gain $\alpha_i$ and, in the second implementation, the matrices W and H, the gain vector $\gamma_i$ and the frequency adaptation vector $\beta_i$. The discretization of this derivation operation yields the aforementioned update equations (a multiplicative update gradient algorithm, which is known by those of skill in the art).

While the present implementation illustrates the particular case of extracting the representation of a musical component from a representation of a collection of acoustical waves stored on a computer readable medium that includes a representation of the musical component and a representation of a residual component, the process of the invention is fit to be used for the extraction, from the representation of any collection of acoustical waves stored on a computer readable medium, of any representation of a specific acoustical component for which a reference representation is available. The specific acoustical component can be music, an audio effect, a voice, etc.

While the exemplary embodiments disclosed herein pertain to the extraction of components from representations of acoustical waves, one of ordinary skill in the art will appreciate that the methods and systems described in the present application are not limited to acoustical waves. The methods and systems described in the present application are also applicable to the extraction of components from representations of other types of waves. For example, representations of other types of waves stored on computer readable media may be modified according to the systems and methods of the present invention.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and "at least one" and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B") is to be construed to mean one item selected from the listed items (A or B) or any combination of two or more of the listed items (A and B), unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in ail possible variations thereof is encompassed by the invention unless otherwise indicated herein or otherwise clearly contradicted by context.

The invention claimed is:

1. A non-transitory computer readable medium containing computer executable instructions for extracting a reference representation from a mixture representation to generate a residual representation, the reference representation, the mixture representation, and the residual representation being time-frequency representations of collections of acoustical waves stored on computer readable media, the medium comprising:

computer executable instructions for applying a time-frequency transform to a time-domain representation of acoustical waves corresponding to the mixture representation in order to obtain the mixture representation;

computer executable instructions for performing an estimation-correction loop that includes, at each iteration, an estimation function and a correction function, the computer executable instructions for performing the estimation-correction loop comprising:

computer executable instructions for producing a new estimation of a power spectral density of the residual representation by minimizing a divergence of a power spectral density of the mixture representation and a sum of a prior estimation of a power spectral density of the residual representation and a corrected power spectral density of the reference representation, wherein the prior estimation of a power spectral density of the residual representation is one of an initial estimation of a power spectral density of the residual representation or a new estimation of a power spectral density of the residual representation determined during a prior iteration, and wherein the corrected power spectral density of the reference representation is one of an initial corrected power spectral density of the reference representation or a prior iteration corrected power spectral density of the reference representation determined during a prior iteration, and;

computer executable instructions for producing, using the mixture representation and the time-frequency version of the reference representation, a new corrected power spectral density of the reference representation; computer executable instructions for filtering the mixture representation using the estimated power spectral density of the residual representation and the corrected power spectral density of the reference representation; and computer executable instructions for storing the residual representation.

2. The non-transitory computer readable medium of claim 1, wherein the medium further comprises:

computer executable instructions for applying a time-frequency transform to a time domain representation of acoustical waves corresponding to the reference representation in order to obtain the reference representation; and computer executable instructions for applying an inverse time-frequency transform to the residual representation in order to obtain a time domain representation of acoustical waves corresponding to the residual representation.

3. The non-transitory computer readable medium of claim 1 wherein the divergence is the ITAKURA-SAITO divergence.

4. The non-transitory computer readable medium of claim 1 wherein the instructions for producing a new estimation of a power spectral density of the residual representation comprise instructions for estimating a power spectral density of the residual representation with the equation:

$$PY_i = W_i H_i,$$

wherein $PY_i$ is the power spectral density of the residual representation, $W_i$ is a matrix $(w_i^{j,k})$ of J lines by K columns corresponding to elementary spectral shapes, and $H_i$ is a matrix $(h_i^{k,l})$ of K lines and L columns corresponding to a time of activation of the elementary spectral shapes.

5. The non-transitory computer readable medium of claim 4 wherein the instructions for producing a new estimation of a power spectral density of the residual representation comprise instructions for updating, at each iteration, the matrices $W_i$ and $H_i$ according to the equations:

$$W_{i+1} = W_i \cdot \frac{((W_i H_i + PS_i))^{\wedge(-2)} \cdot |X|^2) \cdot H_i^T}{(W_i H_i + PS_i)^{\wedge(-1)} \cdot H_i^T}$$

$$H_{i+1} = H_i \cdot \frac{W_i^T \cdot ((W_i H_i + PS_i)^{\wedge(-2)} \cdot |X|^2)}{W_i^T \cdot (W_i H_i + PS_i)^{\wedge(-1)}}$$

wherein $|X|^2$ is the squared modulus of the complex amplitude of the mixture representation and $PS_i$ is the corrected power spectral density of the reference representation.

6. The non-transitory computer readable medium of claim 3 wherein the instructions for producing a new estimation of a power spectral density of the residual representation comprise instructions for estimating a power spectral density of the residual representation with the equation:

$$PY_i = W_i H_i,$$

wherein $PY_i$ is the power spectral density of the residual representation, $W_i$ is a matrix $(w_i^{j,k})$ of J lines by K columns corresponding to elementary spectral shapes, and $H_i$ is a matrix $(h_i^{k,l})$ of K lines and L columns corresponding to a time of activation of the elementary spectral shapes.

7. The non-transitory computer readable medium of claim 6 wherein the instructions for producing a new estimation of a power spectral density of the residual representation comprise instructions for updating, at each iteration, the matrices $W_i$ and $H_i$ according to the equations:

$$W_{i+1} = W_i \cdot \frac{((W_i H_i + PS_i))^{\wedge(-2)} \cdot |X|^2) \cdot H_i^T}{(W_i H_i + PS_i)^{\wedge(-1)} \cdot H_i^T}$$

$$H_{i+1} = H_i \cdot \frac{W_i^T \cdot ((W_i H_i + PS_i)^{\wedge(-2)} \cdot |X|^2)}{W_i^T \cdot (W_i H_i + PS_i)^{\wedge(-1)}}$$

wherein $|X|^2$ is the squared modulus of the complex amplitude of the mixture representation and $PS_i$ is the corrected power spectral density of the reference representation.

8. The non-transitory computer readable medium of claims 1 wherein the instructions for producing a new corrected power spectral density of the reference representation comprise instructions for producing a new corrected power spectral density of the reference representation with a function having the shape:

$$PS_i = \Im_i(|S|^2) = \alpha_i |S|^2$$

wherein $PS_i = \Im_i(|S|^2)$ is the new corrected power spectral density of the reference representation, $|S|^2$ is an element-by-element square of a modulus of a complex amplitude of the reference representation, and $\alpha_i$ is a gain.

9. The non-transitory computer readable medium of claim 8 wherein the instructions for producing a new corrected power spectral density of the reference representation comprise instructions for updating, during each iteration, the gain $\alpha_i$ according to the equation:

$$\alpha_{i+1} = \alpha_i \cdot \frac{\sum_{j,l} \left(|S|^2 \cdot (W_i H_i + \alpha_i \cdot |S|^2)^{\wedge(.-2)} \cdot |X|^2\right)}{\sum_{j,l} (|S|^2 \cdot (W_i H_i + \alpha_i |S|^2)^{\wedge(.-1)})},$$

wherein $W_i$ is a matrix $(w_i^{j,k})$ of J lines by K columns corresponding to elementary spectral shapes, and $H_i$ is a matrix $(h_i^{k,l})$ of K lines and L columns corresponding to a time of activation of the elementary spectral shapes, and $|X|^2$ is the squared modulus of the complex amplitude of the mixture representation.

10. The non-transitory computer readable medium of claim 1 wherein the instructions for producing a new corrected power spectral density of the reference representation comprise instructions for producing a new corrected power spectral density of the reference representation with a function having the shape:

$$PS_i = \Im_i(|S|^2) = \mathrm{diag}(\beta_i) \cdot |S|^2 \cdot \mathrm{diag}(\gamma_i)$$

wherein $PS_i = \Im_i(|S|^2)$ is the new corrected power spectral density of the reference representation, $|S|^2$ is the square of a complex amplitude of the reference representation, $\beta_i$ a vector of frequency adaptation factors, and $\gamma_i$ is a vector of gain per time frame.

11. The non-transitory computer readable medium of claim 10 wherein the instructions for producing a new corrected power spectral density of the reference representation comprise instructions for updating, during each iteration, a gain factor in time $\gamma_i$ and a vector of frequency adaptation factor $\beta_i$ according to the equations:

$$\gamma_{i+1} = \gamma_i \cdot \frac{\sum_{j} \left(\mathrm{diag}(\beta_i)|S|^2 \cdot (W_i H_i + \mathrm{diag}(\beta_i)|S|^2 \mathrm{diag}(\gamma_i))^{\wedge(.-2)} \cdot |X|^2\right)}{\sum_{j} (\mathrm{diag}(\beta_i)|S|^2 \cdot (W_i H_i + \mathrm{diag}(\beta_i)|S|^2 \mathrm{diag}(\gamma_i))^{\wedge(.-1)})},$$

$$\beta_{i+1} = \beta_i \cdot \frac{\sum_{l} \left(|S|^2 \mathrm{diag}(\gamma_i) \cdot (W_i H_i + \mathrm{diag}(\beta_i)|S|^2 \mathrm{diag}(\gamma_i))^{\wedge(.-2)} \cdot |X|^2\right)}{\sum_{l} (|S|^2 \mathrm{diag}(\gamma_i) \cdot (W_i H_i + \mathrm{diag}(\beta_i)|S|^2 \mathrm{diag}(\gamma_i))^{\wedge(.-1)})},$$

wherein $W_i$ is a matrix $(w_i^{j,k})$ of J lines by K columns corresponding to elementary spectral shapes, and $H_i$ is a matrix $(h_i^{k,l})$ of K lines and L columns corresponding to a time of activation of the elementary spectral shapes, and $|X|^2$ is the squared modulus of the complex amplitude of the mixture representation.

12. A system for extracting a reference representation from a mixture representation and generating a residual representation, the reference representation, the mixture representation, and the residual representation being time-frequency representations of collections of acoustical waves stored on computer readable media, the system comprising:

a processor configured to:

apply a time-frequency transform to a time domain representation of acoustical waves corresponding to the mixture representation in order to obtain the mixture representation, and perform an estimation-correction loop that includes, at each iteration an estimation function and a correction function, wherein the estimation function comprises producing a new estimation of a power spectral density of the residual representation by minimizing a divergence of a power spectral density of the mixture representation and a sum of a prior estimation of a power spectral density of the residual representation and a corrected power spectral density of the reference representation, wherein the prior estimation of a power spectral density of the residual representation is one of an initial estimation of a power spectral density of the residual representation or a new estimation of a power spectral density of the residual representation determined during a prior iteration, and wherein the corrected power spectral density of the reference representation is one of an initial corrected power spectral density of the reference representation or a prior iteration corrected power spectral density of the reference representation determined during a prior iteration, and wherein the correction function comprises producing, using the mixture representation and the time-frequency version of the reference representation, a new corrected power spectral density of the reference representation, and perform a filtering that is designed to obtain, from the reference representation, from a final new estimation of a power spectral density of the residual representation, and from a final new corrected power spectral density of the reference representation, the residual representation,.

13. The system of claim 12 wherein the processor is further configured to:

apply a time-frequency transform to a time domain representation of acoustical waves corresponding to the reference representation in order to obtain the reference representation; and apply an inverse time-frequency transform to the residual representation in order to obtain a time domain representation of acoustical waves corresponding to the residual representation.

14. The system of claim 1 wherein the divergence is the ITAKURA-SAITO divergence.

15. The system of claim 12 wherein producing a new estimation of a power spectral density of the residual representation is performed according to the equation:

$$PY_i = W_i H_i,$$

wherein $PY_i$ is the power spectral density of the residual representation, $W_i$ is a matrix $(w_i^{j,k})$ of J lines by K columns corresponding to elementary spectral shapes, and $H_i$ is a matrix $(h_i^{k,l})$ of K lines and L columns corresponding to a time of activation of the elementary spectral shapes.

16. The system of claim 15 wherein minimizing a divergence of a power spectral density of the mixture representation and a sum of a prior estimation of a power spectral density of the residual representation and a corrected power spectral density of the reference representation is performed by updating, at each iteration of the estimation step, the matrices $W_i$ and $H_i$ according to the equations:

$$W_{i+1} = W_i \cdot \frac{((W_i H_i + PS_i))^{\wedge(.-2)} \cdot |X|^2) \cdot H_i^T}{(W_i H_i + PS_i)^{\wedge(.-1)} \cdot H_i^T}$$

$$H_{i+1} = H_i \cdot \frac{W_i^T \cdot ((W_i H_i + PS_i)^{\wedge(.-2)} \cdot |X|^2)}{W_i^T \cdot (W_i H_i + PS_i)^{\wedge(.-1)}}$$

wherein $|X|^2$ is the squared modulus of the complex amplitude of the mixture representation, and $PS_i$ is the corrected power spectral density of the reference representation.

17. The system of claim 14 wherein producing a new estimation of a power spectral density of the residual representation is performed according to the equation:

$$PY_i = W_i H_i,$$

wherein $PY_i$ is the power spectral density of the residual representation, $W_i$ is a matrix $(w_i^{j,k})$ of J lines by K columns corresponding to elementary spectral shapes, and $H_i$ is a matrix $(h_i^{k,l})$ of K lines and L columns corresponding to a time of activation of the elementary spectral shapes.

* * * * *